US011028345B2

(12) United States Patent
Stern

(10) Patent No.: US 11,028,345 B2
(45) Date of Patent: Jun. 8, 2021

(54) ORGANIC HEMP DRYER SHEET

(71) Applicant: Ava Stern, Menlo Park, CA (US)

(72) Inventor: Ava Stern, Menlo Park, CA (US)

( * ) Notice: Subject to any disclaimer, the term of this patent is extended or adjusted under 35 U.S.C. 154(b) by 0 days.

(21) Appl. No.: 16/697,324

(22) Filed: Nov. 27, 2019

(65) Prior Publication Data

US 2020/0165544 A1 May 28, 2020

Related U.S. Application Data

(60) Provisional application No. 62/771,872, filed on Nov. 27, 2018.

(51) Int. Cl.

| | |
|---|---|
| ***C11D 17/04*** | (2006.01) |
| ***C11D 3/382*** | (2006.01) |
| ***C11D 3/00*** | (2006.01) |
| ***C11D 11/00*** | (2006.01) |
| ***C11D 3/50*** | (2006.01) |
| ***C11D 17/06*** | (2006.01) |

(52) U.S. Cl.

CPC ..... *C11D 3/382* (2013.01); *C11D 3/0068* (2013.01); *C11D 3/50* (2013.01); *C11D 11/0017* (2013.01); *C11D 17/06* (2013.01)

(58) Field of Classification Search

CPC ..... C11D 17/047; C11D 3/001; C11D 17/041

See application file for complete search history.

(56) References Cited

U.S. PATENT DOCUMENTS

| | | | | |
|---|---|---|---|---|
| 4,022,938 | A * | 5/1977 | Zaki | C11D 1/835 427/242 |
| 5,080,810 | A | 1/1992 | Smith et al. | |
| 5,085,892 | A * | 2/1992 | Corona | C11D 1/75 427/365 |
| 5,174,911 | A | 12/1992 | Lin et al. | |
| 5,300,238 | A | 4/1994 | Lin et al. | |
| 6,238,730 | B1 | 5/2001 | Smith et al. | |
| 6,825,163 | B1 | 11/2004 | Kvita et al. | |
| 6,956,020 | B2 | 10/2005 | Kvita et al. | |
| 7,943,566 | B2 | 5/2011 | Uitenbrock et al. | |
| 7,947,644 | B2 | 5/2011 | Uitenbrock et al. | |
| 9,212,342 | B2 | 12/2015 | Ramirez et al. | |
| 2007/0215057 | A1* | 9/2007 | Geer | A01K 1/0047 119/165 |
| 2011/0028380 | A1* | 2/2011 | Aouad | C11D 17/047 510/520 |
| 2015/0126430 | A1* | 5/2015 | Ramirez | C11D 3/0068 510/513 |
| 2017/0298294 | A1* | 10/2017 | Kohle | C11D 3/001 |
| 2018/0338502 | A1* | 11/2018 | Hayes | C11D 3/48 |
| 2019/0367850 | A1* | 12/2019 | Panandiker | C11D 3/373 |

* cited by examiner

*Primary Examiner* — John R Hardee

(74) *Attorney, Agent, or Firm* — Hall Estill Attorneys at Law; Tyler Mantooth

(57) ABSTRACT

A dryer sheet can be configured to be 100% organic and anti-bacterial. The dryer sheet can have one or more layers of pure hemp material that is woven into a configuration that allows for four or more uses without shredding or otherwise having degraded cleaning of laundry being dried. One or more scents and essential oils may be incorporated into the dryer sheet to impart a predetermined aroma into the laundry being dried.

20 Claims, 3 Drawing Sheets

ORGANIC HEMP DRYER SHEET

RELATED APPLICATION

The present application makes a claim of domestic priority under 35 U.S.C. § 119(e) to U.S. Provisional Patent Application No. 62/771,872 filed Nov. 27, 2018, the contents of which are hereby incorporated by reference.

SUMMARY

A dryer sheet, in accordance with some embodiments, is configured to be 100% organic and anti-bacterial with one or more layers of pure hemp material that is woven into a configuration that allows for four or more uses without shredding or otherwise having degraded cleaning performance for laundry being dried. One or more scents and essential oils may be incorporated into the dryer sheet to impart a predetermined aroma into the laundry being dried.

These and other features which may characterize various embodiments can be understood in view of the following detailed discussion and the accompanying drawings.

DETAILED DESCRIPTION

Figure 1:
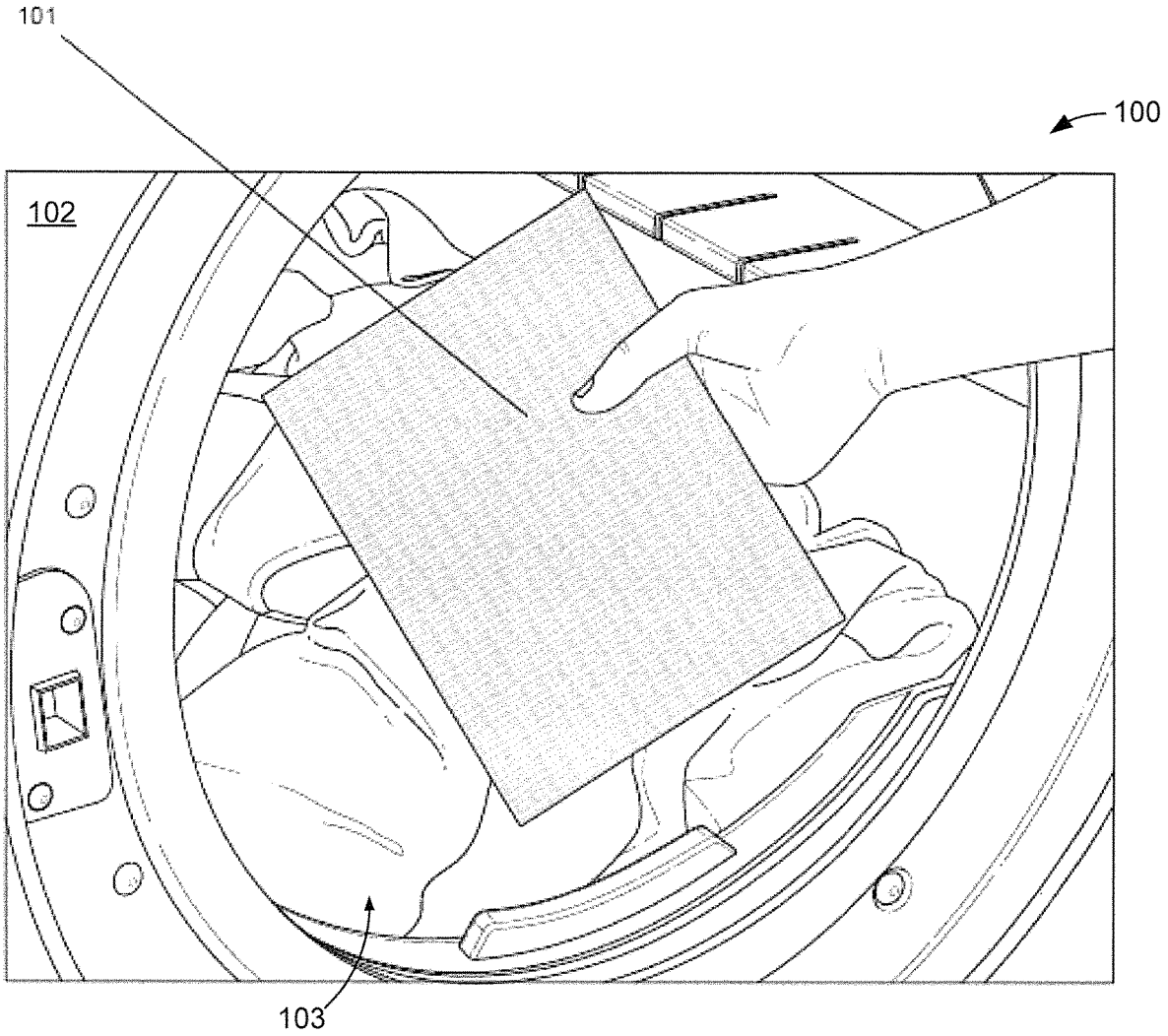
FIG. 1 depicts a line representation of portions of an example dryer sheet utilized in accordance with various embodiments.

Various embodiments of a dryer sheet disclosed herein are directed to optimizing incorporation of clothes cleaning into tumble-style automatic dryers with an organic and anti-bacterial sheet material. More particularly, embodiments relate to a hemp-derived organic dryer sheet.

Conventional dryer sheets have been used to condition clothing placed in a dryer. For example, dryer sheets may be utilized to soften clothes and prevent static cling. The application of fabric softening chemicals to fabrics in the tumble dryer by use of a flexible substrate may provide increased convenience and efficiency dryer-added fabric conditioning that avoidance of undesirable interaction of softening agents with detergents.

Following the laundering of fabrics in a separate washing machines, dryer sheets are generally utilized to treat the fabrics with fabric softening chemicals, not only to soften them, but to give them greater bulk, make them less wrinkled and easier to iron, decrease fabric drying time, and reduce static charge.

It is contemplated that a fabric softening chemical can be used in detergents, rinses, and dryer sheets, such N-dihydrogenated tallow-N or N-dimethylammonium chloride (DTMAC), which are both inexpensive and effective as a softener but, on the other hand, have certain deficiencies, such as its yellowing and reducing the washability of the softened fabrics, having inefficient antistatic activity on polyesters, and decreasing the rewettability of the treated fabrics.

Moreover, other chemicals, such as amine oxides, may also be incorporated into dryer sheets as fabric softeners. When thus utilized, such other chemicals have most commonly been employed as dilute aqueous solutions. Alternative methods of fabric softening disclose the use of solid amine oxides instead of conventional dilute aqueous solutions. Such solid amine oxides may be mixed tert-amine oxides containing at least one long-chain group and at least one short-chain group, in which at least some of the molecules are dihydrate molecules. However, some studies have shown that tert-amine oxides can cause eye irritation, and correspond with adverse side effects in mammals such as lower body weight, diarrhea, and lenticular opacities. Hence, the application of non-organic chemicals for fabric softening purposes can produce adverse human reactions and lead to pollutive by-products during manufacturing.

Dryer sheets can be prepared by soaking an absorbent flexible substrate with an aqueous mixture of the fabric softener components, pressing the resultant soaked sheet to remove any excess surfactant, and then drying the sheet. Dryer sheets known in the art are preferably prepared by coating an absorbent flexible substrate with a molten mixture of the fabric softener components and then solidifying the mixture. However, the composition of dryer sheets known in the art featuring known flexible substrates typically lack the absorbency needed to accommodate essential oils, including organic oils having antibacterial properties. Moreover, the composition of dryer sheets in the art limits their reusability in subsequent dryer cycles after the first cycle.

Due to their nature as paper-based dryer sheets, they lack the strength desirable to have utility as reusable dryer sheets. As such, the one-time use nature of prior art dryer sheets contributes to unnecessary waste and expense, and thereby causes excessive water and electricity consumption. Moreover, farming production crops are increased when expensive chemicals and fertilizers are necessary. Organic farms, in contrast, save energy and protect the environment by mitigating the use of non-organic chemicals and fertilizers that can ultimately prove harmful to humans as consumers of goods produced as a result. Therefore, a desirable need exists to create a product functional as a dryer sheet that incorporates organically grown materials.

Further, dryer sheets known in the art lack chemical-free cleansing properties. While often dryer sheets contain deodorizing properties, typically through methods and processes based on bleach oxidizing agents, peroxides, bactericides, which kill microorganisms, cyclodextrins, and/or zinc ricinoleate. Such compounds tend to form strong bonds with malodor molecules containing sulfur and nitrogen atoms. However, such compounds have been shown to correlate with dermatitis and other adverse reactions. There remains a need to avoid chemicals, such as those potentially present in dryer sheets and detergents, to prevent skin sensitivities and avoid allergic reactions. Thus, a chemical free dryer sheet featuring deodorizing and antibacterial properties is desirable.

Accordingly, various embodiments configure a dryer sheet of 100% organic hemp fiber with the ability to retain and distribute one or more essential oils. In some embodiments, a combination of the dryer sheet and the one or more essential oils leads to a configuration providing one or more scents and evidencing anti-bacterial properties.

FIG. 1 depicts a line representation of portions of an example clothes drying system 100 utilized in accordance with some embodiments with a reusable dryer sheet 101 consisting primarily of organic hemp-derived fiber and capable of absorbing anti-bacterial essential oils.

Hemp fiber has advantageous strength properties. Moreover, it is contemplated that hemp fabric has advantageous properties in association with absorbing essential oils. As such, 100% organic hemp dryer sheets, as described herein, have properties advantageous to allow for multiple uses, such as four or more uses without shredding or otherwise experiencing degraded fabric cleaning performance. In various embodiments, the hemp dryer sheets 101 as described herein are intended for at least four uses.

The use of 100% organic hemp fibers to construct the dryer sheet 101 benefits the environment by avoiding the need to excessively wash fabrics, thereby saving water. Moreover, embodiments of the dryer sheet 101 benefit the environment by minimizing the need to incorporate potentially pollutive soaps and detergents into unnecessary washing cycles. Other embodiments can similarly benefit humans directly by reducing the need for humans to come into contact with chemicals contained in detergents utilized during unnecessary washes and use of traditional chemical-based dryer sheets.

The hemp fabric dryer sheet 101 is configured for placement in a clothes dryer 102 with other fabrics 103 (laundry) to allow for the freshening of said other fabrics 103. In various embodiments, but in no way limiting, the dryer sheet 101 has a rectangular shape, such as each side having a length within the range of 5-12 inches. The hemp fabric dryer sheet 101, during intended usage, provides antibacterial action and the healing properties of organic hemp and essential oils as further described herein.

In various embodiments, the antibacterial hemp fiber dryer sheet 101 is comprised of organically-grown hemp woven into thin yarn with a 0.25 inch or less average thickness, which corresponds with a thickness of Nm 10/2 two-ply natural hemp yarn. In an embodiment, the hemp comprises single strand lace weight yard of a thickness of 36 to 40 wraps per inch that has a 3-6 oz. weight. It is contemplated that 100% hemp fabric can be woven into a dryer sheet 101 that has an average thickness that approximates a sheet of paper, such as 0.01 inches or less, while retaining the ability to impart an antibacterial condition onto laundry by absorbing harmful molecules from laundry being dried.

The organic hemp fiber antibacterial dryer sheet 101 may comprise hemp yarn woven into a cloth via canvas weaves. The weave of the hemp yarn can be chosen to provide a balance of reusability and oil retention with effectiveness of fabric freshening and imparting antibacterial conditions through at least the absorption of bacteria into the dryer sheet 101. In accordance with intended methods of use of embodiments, the fabrics freshened include those such as lightly used damp towels and garments, following placement of such fabrics in the clothes dryer 102 in association with typical operations of the clothes dryer 102.

It is also contemplated to combine oils with the hemp fabric dryer sheet 101 to facilitate the freshening of other fabrics when combined into the clothes dryer 102. The absorbent attributes of hemp fabric are therefore utilized in the form of a hemp fabric dryer sheet 101 to incorporate one or more essential oils. The absorbency of hemp fiber in the context of this disclosure allows for it to uniquely provide for the ability to absorb oils to further facilitated the freshening of other fabrics in the context of the clothes dryer 102. In some embodiments, the hemp fabric dryer sheet 101 is manufactured to incorporate one or more essential oils prior to offer of sale to an end user. In other embodiments, essential oils may be applied following the initial use if desired by the user to gain the benefit of essential oils during subsequent uses.

Figure 2:
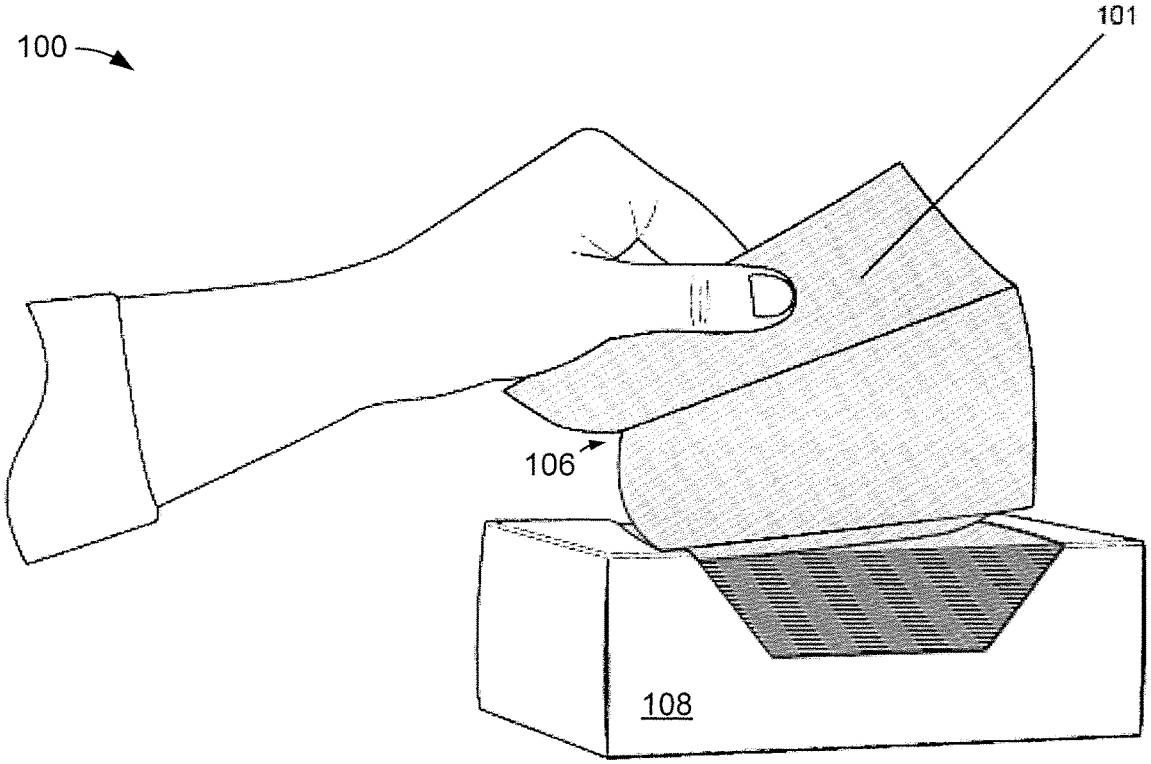
FIG. 2 depicts a line representation of portions of an example dryer sheet configured in accordance with some embodiments.

As a non-limiting embodiment, a drying system 100 consists of a plurality of hemp fabric dryer sheets 101 placed into packaging configured to contain a plurality of hemp fabric dryer sheets 101 as depicted in FIG. 2. Each dryer sheet 101 can have one or more predetermined folds 106 that allow the consolidation of sheets 101 into a single separate container 108. It is contemplated that the container 108 may hold essential oils or be utilized in the dispensing of external essential oils onto one or more dryer sheets 101. In an embodiment, the separate container 108 will display at least one color to represent one specific scent corresponding to an essential oil. In an alternative embodiment, the hemp fabric dryer sheet 101 is manufactured without any essential oil, enabling the end user to later incorporate the desired essential oil.

It is contemplated that the natural qualities of hemp, which allow the hemp fabric dryer sheet 101 to be prepared without the addition of chemicals potentially harmful to mammals. It is noted that many essential oils comprise all-natural, organic ingredients that may be formulated into a solution to replace the problem associated with typically utilized dryer sheet chemical formulations that generally incorporating inorganic chemical compounds that may pose some risk to mammals. It is therefore an embodiment of a dryer sheet 101 to comprise only organic ingredients, such as hemp and oil.

Embodiments of a hemp fabric dryer sheet 101 may have multiple essential oils and/or scents incorporated into a single layer of hemp fibers. A variety of oils and/or scents can concurrently, or independently, be utilized in a single dryer sheet 101 to provide excellent antibacterial qualities. It is noted that such oils, when combined with and/or absorbed into a hemp fabric dryer sheet 101, allow for freshening of other fabrics enclosed within a clothes dryer 102 in association with the normal operation of said clothes dryer 102.

Many essential oils are suitable for disinfection due to their antibacterial properties. Additionally, some essential oils are high in aldehydes, which are associated with antifungal properties. A non-limiting list of oils usable in a dryer sheet 101 is as follows: tea tree essential oil, peppermint essential oil, lemon essential oil, lavender essential oil, rosemary essential oil, geranium essential oil, lime essential oil, grapefruit essential oil, orange essential oil, cannabis-derived essential oil and any combination thereof. The distinctive characteristics of hemp fabric make it an excellent carrier for the above listed oils while providing the ability to absorb harmful molecules, such as bacteria, from the laundry while being dried. Thus, the complementary nature of the antibacterial aspects of such oils in addition to the antibacterial aspects of hemp fabric can be utilized to provide optimized laundry drying.

The potency of antibacterial properties/methods of incorporating essential oils having antibacterial properties can be customized. For instance, cannabanoids, which is one of the typical group of compounds present in hemp, have been found to show excellent antibacterial activity applicable to the freshening, which may involve disinfecting, of fabrics. It is noted that researchers have reported the antibacterial activity of hemp against a wide range of bacteria, deriving from the five major cannabinoids from hemp: Cannabidiol (CBD), Cannabichromere (CBC), Cannabigerol (CBG), Delta-9-Tetrahydrocannabinol (THC) and Cannabinol (CBN). Thus, various embodiments utilize variants of hemp that have a high content of CBD and THC, in particular, resulting in strong antimicrobial activity. Additionally, hemp cloth utilized in the composition of the dryer sheet 101 may have a high content of hemp exhibiting concentrations of any of the group comprising CBD, CBC, CBG, CBN and THC, to harness the antimicrobial capability of such cannabinoids.

Figure 3:
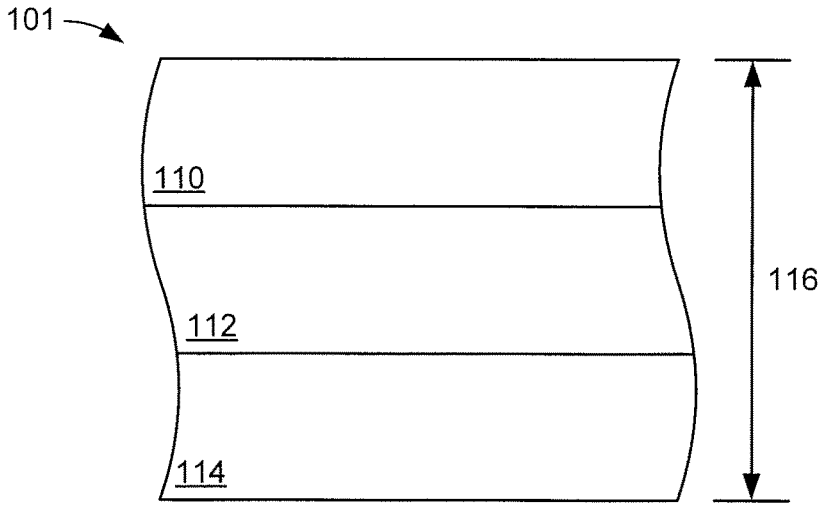
FIG. 3 depicts a cross-sectional line representation of portions of an example dryer sheet constructed and utilized in accordance with assorted embodiments.

FIG. 3 depicts a cross-sectional line representation of a portion of an example organic dryer sheet 101 constructed in accordance with various embodiments. While the sheet 101 may consist of a single layer of woven 100% organic hemp fiber, some embodiments utilize multiple layers of hemp fiber to provide a diverse variety of practical advantages. For instance, different layers 110, 112, and 114 can be configured with different weights, weaves, and thicknesses 116 to provide a biodegradable sheet 101 that can reliably be used at least four times without shedding, shredding, or otherwise disintegrating in a manner that degrades clothes cleaning and/or freshening performance.

Figure 4:
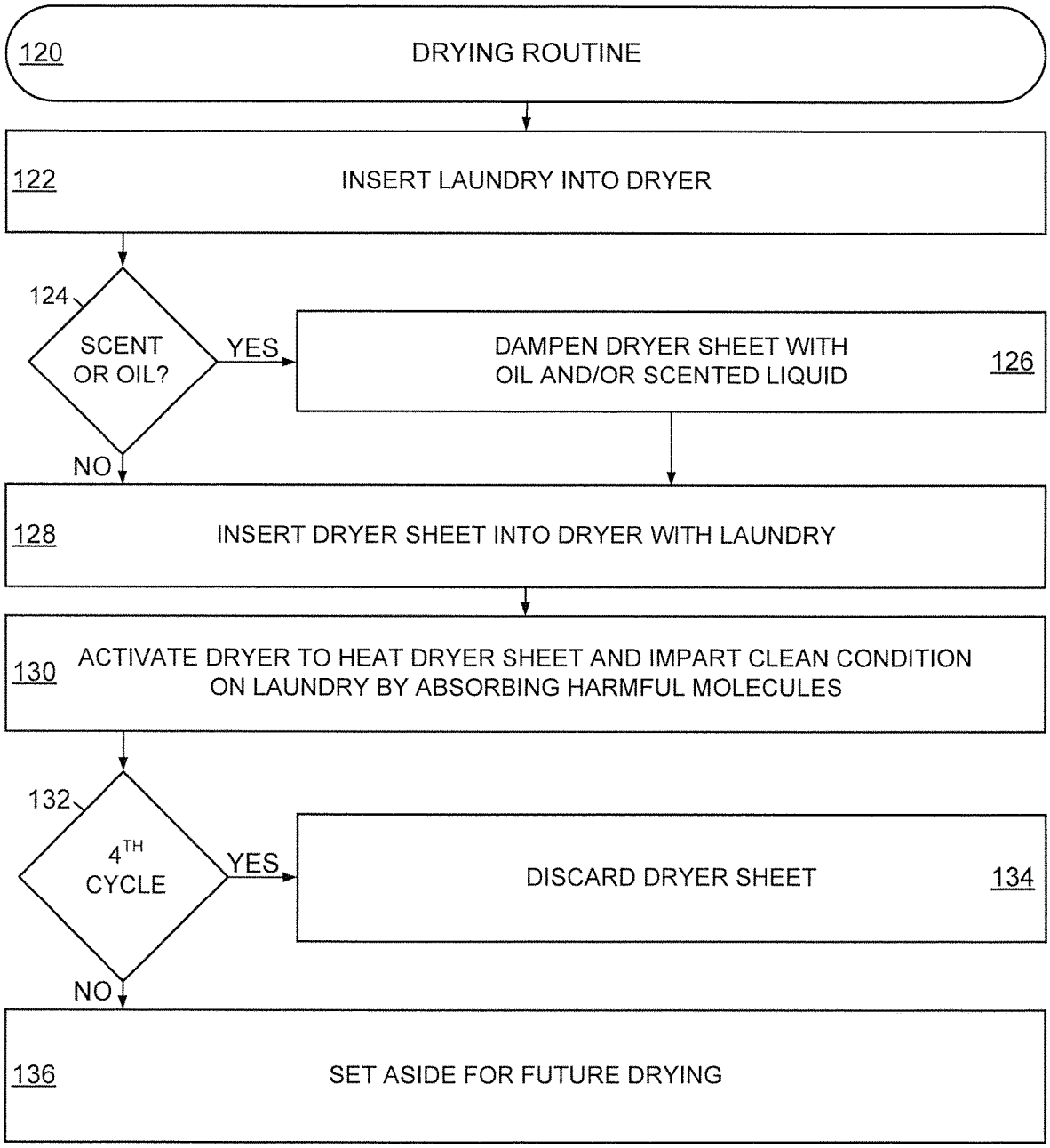
FIG. 4 depicts an example drying routine that can be carried out with the various embodiments of FIGS. 1-3.

In accordance with assorted embodiments a dryer sheet 101 can be utilized to condition laundry in the drying routine 120 of FIG. 4. First in step 122, laundry to be dried is positioned in a clothes dryer, such as dryer 102. Decision 124 next evaluates if a scent or oil is to incorporated into a dryer sheet. If so, step 126 dampens at least one dryer sheet with an oil or otherwise scented liquid. It is noted that step 126 may be skipped in the event a dryer sheet has scents and/or essential oils already incorporated into the sheet during a manufacturing and packaging process.

The damp dryer sheet, or dry dryer sheet in the event decision 124 does not prescribe the application of a scent and/or oil, is then inserted into the clothes dryer in step 128. Then, step 130 activates the dryer sheet to impart an antibacterial condition on the proximal laundry via heat and physical contact from tumbling that allows bacteria, and potentially other harmful molecules, to be absorbed by the dryer sheet. It is contemplated that without necessarily cleaning the laundry, a user can utilize the practical advantages of an organic dryer sheet by engaging in a water free freshening step by starting the tumbling and/or air circulation operations of the clothes dryer with the hemp fabric dryer sheet 101 and the laundry, which freshens and at least partially disinfects the laundry.

With the laundry at least freshened, and perhaps cleaned, with the dryer sheet applying one or more anti-bacterial, clothes freshening, scents, and/or oils onto the laundry, decision 132 evaluates if the dryer sheet is fit for another heating and/or tumbling cycle in the clothes dryer. It is noted that while routine 120 limits decision 132 to four cycles, such number is not required or limiting and more cycles can be utilized before the dryer sheet shows signs of disintegration or otherwise degraded performance, such as reduced thickness, increased stiffness, or holes. If degradation is evident, decision 132 triggers step 134 to discard the dryer sheet for recycling. However, if no signs of dryer sheet degradation are evident, decision 132 prompts step 136 to set the dryer sheet aside for future use in association with freshening, drying, scenting, or oiling laundry.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An apparatus comprising a dryer sheet constructed as a single layer of 100% organic hemp fibers with an average thickness of 0.25 inches or less woven together to produce a dryer sheet thickness of 0.01 inches or less, the dryer sheet consisting of only hemp fibers without any additional chemicals and oils.

2. The apparatus of claim 1, wherein the dryer sheet is woven via canvas weaves.

3. The apparatus of claim 1, wherein the 100% organic hemp fibers have a weight of 3-6 ounces.

4. The apparatus of claim 3, wherein the dryer sheet has rectangular dimensions of 5 inches by 8 inches.

5. The apparatus of claim 3, wherein the dryer sheet has rectangular dimensions with sides measuring 5-12 inches.

6. The apparatus of claim 1, wherein the 100% organic hemp fibers are free of any artificial or synthetic chemicals before and during use in a clothes dryer.

7. The apparatus of claim 1, wherein the dryer sheet retains an essential oil applied by a user.

8. The apparatus of claim 7, wherein the dryer sheet retains a plurality of different essential oils each applied to the dryer sheet by the user.

9. The apparatus of claim 1, wherein the dryer sheet is constructed of two-ply yarn having 36 to 40 wraps per inch.

10. An apparatus comprising a dryer sheet constructed of a plurality of layers, each of the plurality of layers comprising 100% organic hemp fibers having an average thickness of 0.25 inches or less woven together to produce a dryer sheet thickness of 0.01 inches or less, each layer of the plurality of layers consisting of only hemp fibers without any additional chemicals and oils.

11. The apparatus of claim 10, wherein a first layer of the plurality of layers has a different weight than a second layer of the plurality of layers.

12. The apparatus of claim 10, wherein a first layer of the plurality of layers has a different weave than a second layer of the plurality of layers.

13. The apparatus of claim 10, wherein a first layer of the plurality of layers has a different average thickness than a second layer of the plurality of layers.

14. The apparatus of claim 10, wherein the dryer sheet is fully biodegradable.

15. The apparatus of claim 10, wherein the plurality of layers comprises three separate layers sewn together.

16. A method comprising:

inserting laundry in a clothes dryer at least four separate times;

inserting a dryer sheet into the clothes dryer each of the at least four separate times, the dryer sheet comprising 100% organic hemp fibers with an average thickness of 0.25 inches or less woven together to produce a dryer sheet thickness of 0.01 inches or less, the dryer sheet consisting of only hemp fibers without any additional chemicals and oils, the dryer sheet having a scent corresponding with the 100% organic hemp fibers;

activating the clothes dryer for each of the at least four separate times; and absorbing at least one bacterial molecule from the laundry into the dryer sheet during each of the at least four separate times.

17. The method of claim 16, wherein one or more essential oils are applied to the dryer sheet prior to insertion into the clothes dryer.

18. The method of claim 16, wherein heat from the clothes dryer imparts a clean condition by absorbing at least one harmful molecule from the laundry.

19. The method of claim 16, wherein physical movement of the dryer sheet imparts at least a scent onto the laundry.

20. The method of claim 16, wherein the activation of the clothes dryer imparts an antibacterial condition on the laundry by absorbing at least one bacterial molecule from the laundry.

* * * * *